US011624597B1

(12) United States Patent
Hollis et al.

(10) Patent No.: US 11,624,597 B1
(45) Date of Patent: Apr. 11, 2023

(54) HYBRID ANNULAR-CANTILEVERED SNAP-FIT JOINT

(71) Applicant: U.S. Government as Represented by the Secretary of the Army, Dover, NJ (US)

(72) Inventors: Michael Hollis, Flanders, NJ (US); Leroy McGuire, Randolph, NJ (US); Michael Donovan, Stroudsberg, PA (US); Thomas Gardner, Roseto, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 17/703,587

(22) Filed: Mar. 24, 2022

Related U.S. Application Data

(60) Provisional application No. 63/165,758, filed on Mar. 25, 2021.

(51) Int. Cl.
*F42B 15/36* (2006.01)
*F42B 10/26* (2006.01)
*F42B 30/08* (2006.01)

(52) U.S. Cl.
CPC ..... *F42B 15/36* (2013.01); *F42B 10/26* (2013.01); *F42B 30/08* (2013.01)

(58) Field of Classification Search
CPC ..... F16B 7/0406; F16B 7/0413; F16B 7/042; F42B 10/26; F42B 15/36; F42B 30/003; F42B 30/08; F42B 30/10
See application file for complete search history.

(56) References Cited

U.S. PATENT DOCUMENTS 2,998,772 A 9/1961 Land
3,183,024 A * 5/1965 Myers ..... F42B 15/36 285/332
3,455,579 A * 7/1969 Puckett ..... F16L 37/0985 285/308
3,547,036 A * 12/1970 Brothers ..... F42B 30/08 102/517
4,348,956 A * 9/1982 Schmidlin ..... F16B 7/0413 403/321
4,771,696 A * 9/1988 Smolnik ..... F42B 30/003 102/293
5,394,803 A 3/1995 Mort
(Continued)

FOREIGN PATENT DOCUMENTS

CH 580797 A * 10/1976 ..... F42B 30/08
DE 2062454 A1 * 7/1972
(Continued)

*Primary Examiner* — Gabriel J. Klein
(74) *Attorney, Agent, or Firm* — John P. DiScala

(57) ABSTRACT

A safe and reliable multi-component projectile enables cost effective manufacturing and assembly of the projectile. Major components of the projectile are joined by a plurality of shear pins interfacing with scalloped geometry of the components. The components are then held together by forcibly joining them using a hybrid annular-cantilevered snap fit joint. The tooth and groove arrangement exists where the teeth are at the end of a spring-leaf like feature of one of the mating parts and the groove is located on the opposite mating part.

13 Claims, 6 Drawing Sheets

(56) References Cited

U.S. PATENT DOCUMENTS

| | | | | |
|---|---|---|---|---|
| 6,640,720 | B1 | 11/2003 | Biserod | |
| 8,578,855 | B2 * | 11/2013 | Diehl | F16L 13/06 102/470 |
| 10,634,473 | B2 * | 4/2020 | Travis | F42B 15/36 |
| 2008/0011180 | A1 * | 1/2008 | Stimpson | F42B 15/36 102/377 |
| 2015/0211832 | A1 * | 7/2015 | Travis | F42B 15/36 285/330 |
| 2016/0033069 | A1 * | 2/2016 | Buttolph | F42B 15/36 403/320 |
| 2019/0249966 | A1 * | 8/2019 | Rice | F16B 7/182 |

FOREIGN PATENT DOCUMENTS

| | | | |
|---|---|---|---|
| EP | 0395456 | A1 * | 10/1990 |
| FR | 2520434 | A1 * | 7/1983 |
| FR | 2658284 | A1 * | 8/1991 |

* cited by examiner

HYBRID ANNULAR-CANTILEVERED SNAP-FIT JOINT

CROSS-REFERENCE TO RELATED APPLICATIONS

This application claims the benefit under 35 USC §119(e) of U.S. provisional patent application 63/165,758 filed on Mar. 25, 2021.

STATEMENT OF GOVERNMENT INTEREST

The inventions described herein may be manufactured, used and licensed by or for the United States Government.

FIELD OF THE INVENTION

The invention relates in general to projectiles and in particular to multi-piece projectiles.

BACKGROUND OF THE INVENTION

Projectile bodies, such as artillery shells, are often assembled from multiple components. The assembled joints must be sufficient to withstand the high forces often experienced by projectiles. Spin-stabilized artillery projectiles, in particular, must survive immense torque loads that are imposed during cannon launch.

Current methods of assembling spin-stabilized artillery projectiles include using a threaded joint with a thread locking adhesive. The threaded joints have to be strong enough to withstand the forces from the release of stored energy during cannon launch. In some cases, a friction-based surface, such as a face knurling, is also used.

There are downsides to this approach. If not done properly, the threads or components fail under tensile load and the joined parts separate at muzzle exit. If the threaded locking adhesive or frictional surface fail, the components rotate which could lead to other issues. In addition, knurled interfaces are difficult to manufacture consistently and the friction is difficult to measure in a dynamic environment. The components tend to over-tighten or slip.

A need exists for a system and method for creating an artillery projectile with multiple components that are easily, yet robustly, joined together.

SUMMARY OF INVENTION

One aspect of the invention is a projectile comprising a fore portion and an aft portion joined together via an annular cantilevered snap fit joint and a spider assembly. The spider assembly is positioned between the fore portion and the aft portion. The spider assembly further comprises a ring and a plurality of pins inserted into the ring. The pins are received into niches defined by interior surfaces of the fore portion and the aft portion.

Another aspect of the invention is a method for assembling a projectile. The method includes the steps of: providing a fore portion and an aft portion, said aft portion further comprising a plurality of leaf springs arranged circumferentially around an opening of the aft portion and extending in an axial direction and wherein each leaf spring comprises a protruding tooth and said fore portion further comprises a circumferential groove defined by an exterior surface; assembling a spider assembly by inserting a plurality of pins into corresponding holes arranged symmetrically around the ring; inserting the spider assembly in an aft portion of the projectile such that the plurality of rings are received within scalloped niches defined by the interior surface of the fore portion; aligning a fore portion of the projectile with an aft portion of the projectile by aligning scalloped niches defined by the interior surface of the fore portion with the scalloped niches of the aft portion; and applying a force to one of the fore portion or the aft portion such that fore portion and the aft portion are brought together and the protruding teeth are seated within the circumferential groove.

The invention will be better understood, and further objects, features and advantages of the invention will become more apparent from the following description, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION

A safe and reliable multi-component projectile enables cost effective manufacturing and assembly of the projectile. Major components of the projectile are joined by a plurality of shear pins interfacing with scalloped geometry of the components. The components are then held together by forcibly joining them using a hybrid annular-cantilevered snap fit joint. A tooth and groove arrangement exists where the teeth are at the end of a spring-leaf like feature of one of the mating parts and the groove is located on the opposite mating part.

Throughout this specification, the projectile is illustrated in the context of an artillery projectile. More specifically, the specification describes a union between a warhead of an artillery projectile and a rocket motor of an artillery projectile. However, those skilled in the art will recognize that while the projectile and related methods of assembly are suited for an artillery projectile, the projectile and methods of assembly are not limited to artillery projectiles. Rather, the projectile may be any projectile in which two components, a fore portion and an aft portion, must be joined to create the body of the projectile. Further, while the invention is particularly suited to spin-stabilized projectiles, it is not limited to spin-stabilized projectiles.

Artillery projectiles have to withstand large accelerations, both during launch, set-back, and during muzzle exit, set-forward, when the stored potential energy of the projectile is released. Locking the union from axial translation requires a means for keeping the components butting up against each other. The projectile disclosed herein keeps this union from separating using a hybrid annular and cantilevered snap fit joint that comprises a series of spring-like fingers with buttress shaped grooves on one component and corresponding mating features on another component. The tip of the buttress shaped grooves interfere with the mating component; however, as the two components are brought together axially, the tips displace radially outward. The tips of the buttress grooves fall into grooves that are in the mating component as the parts are brought fully together. The flat geometry of the buttress groove is then adjacent and butting up to the flat geometry of the groove, thus locking the two components together axially.

Figure 1:
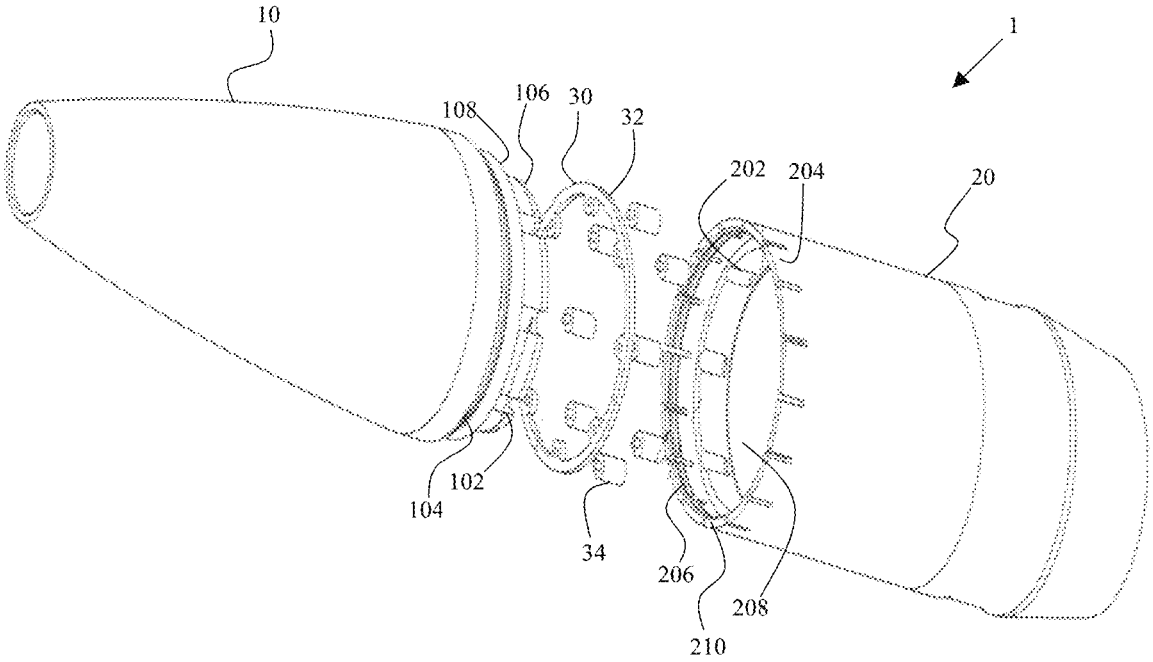
FIG. 1 is an exploded view of an artillery projectile, according to an illustrative embodiment.

FIG. 1 is an exploded view of an artillery projectile, according to an illustrative embodiment. The artillery projectile 1 is a spin stabilized artillery projectile. Spin stabilized, in this context, means the projectile leaves the muzzle spinning at a rate of 100 Hertz (Hz) to over 300 Hz. The artillery projectile 1 is launched from ignited propellant producing sufficient pressure to propel the artillery projectile 1 through a cannon tube.

The artillery projectile 1 comprises a warhead component 10, a rocket motor assembly 20 and a spider assembly 30. The warhead component 10 and rocket motor assembly 20 both comprise cylindrical bodies. A stepped down portion 106 of the warhead component 10 is dimensioned to be received within an opening 208 at the front of the rocket motor assembly 20. When inserted into the rocket motor assembly 20, a top surface 210 of the rocket motor assembly 20 abuts a rim 108 on the exterior of the warhead component 10. The exterior surfaces of the warhead component 10 and the rocket assembly when assembled, form a relatively flush surface with each other.

The warhead component 10 and the rocket motor assembly 20 are joined via the spider assembly 30 and a hybrid annular and cantilevered snap fit joint.

The spider assembly 30 comprises a ring 32 and a plurality of pins 34 which enable the assembly of the artillery projectile joint to be both simple and precise. When assembled, the spider assembly 30 sits between the warhead component 10 and rocket motor assembly 20 with the ring 32 providing a seal to keep propulsion gases from leaking past the union between the two. A bottom surface of the ring 32 sits on a rim 212 in the interior of the rocket motor assembly 20. The ring 32 consists of a semi-malleable material, such as soft stainless steel. The union of the projectile components requires a slight deformation of the malleable ring 32 of the spider assembly 30.

The pins 34 are shear pins which serve as torque transmitting components. When assembled, the pins 34 are positioned in corresponding scalloped niches 102, 202 formed in the exterior surface of the warhead component 10 and an interior surface of the rocket motor assembly 20. The niches 102, 202 are arranged circumferentially in the interior diameter of the rocket motor assembly 20 and exterior diameter of the warhead component 10 and correspond to the pins 34 of the spider assembly 30. When the warhead assembly is inserted and properly positioned, the scalloped niches 102 of the warhead assembly align with the scalloped niches 202 of the rocket motor assembly 20 thereby forming interior volumes sized to accommodate each pin 34.

Figure 2:
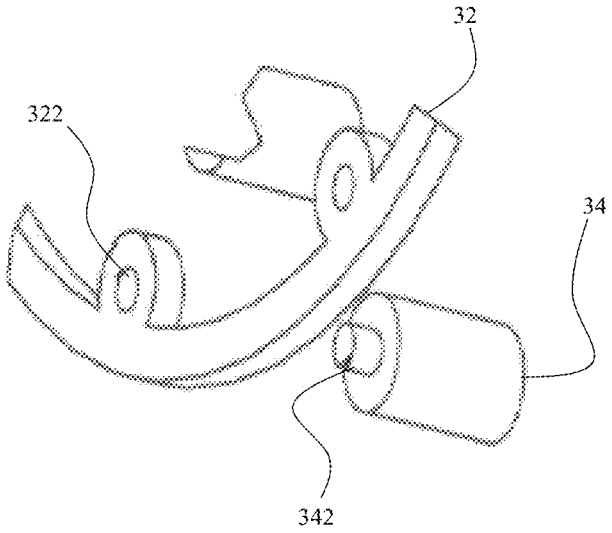
FIG. 2 is a magnified view of a portion of the spider and a pin, according to an illustrative embodiment.

FIG. 2 is a magnified view of a portion of the spider and a pin, according to an embodiment. The bosses 342 of the pins 34 are placed into corresponding holes 322 in the ring 32 to form the spider assembly 30. The holes 322 are arranged symmetrically around the ring 32 such that when inserted into the ring 32, the pins 34 are arranged symmetrically around the ring 32. The pins 34 shown in FIG. 1 and FIG. 2 are cylindrical in shape; however, other geometries, such as hexagonal, prismatic or rectangular, may be used. In addition, while the embodiments show seven (7) pins 34 and scalloped niches 102, 202, the artillery projectile 1 is not limited to seven pins 34 and scalloped niches 102, 202 and may include more or less than seven pins and scalloped niches.

Figure 3:
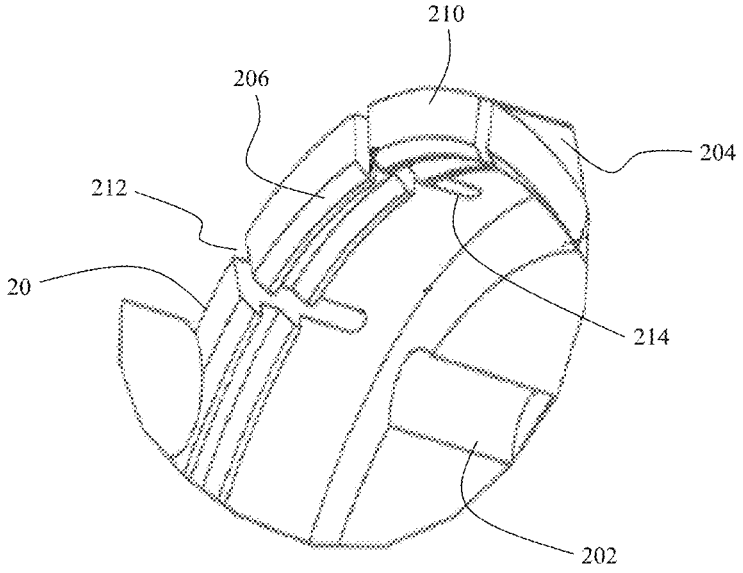
FIG. 3 is a magnified view of spring tabs of a rocket motor of an artillery projectile, according to an illustrative embodiment.

FIG. 3 is a magnified view of spring tabs of a rocket motor of an artillery projectile, according to an illustrative embodiment. The rocket motor assembly 20 comprises a plurality of spring tabs 204 at the opening 208 of the rocket motor assembly 20 proximate the warhead component 10. The spring tabs 204 may be formed on the warhead as integral features. In this embodiment, the spring tabs 204 are made of the same high strength steel. In one embodiment, the spring tabs 204 are manufactured by turning the part on a lathe and then machining slits 212 in the wall of the rocket motor assembly 20 thereby creating multiple spring tabs 204. For example, the slits may be created with a mill cutter, slitting saw or some other process familiar to those on manufacturing.

Each spring tab 204 further comprises one or more buttress teeth 206. The number of teeth is governed by the amount of permissible stress during set forward. When assembled, the buttress teeth 206 of the spring tabs 204 are seated in a groove 104 located on an exterior surface of the warhead proximate the rocket motor assembly 20. The sloped surface of the leading edge of the teeth 206 are shaped to allow the teeth 206 to slide over mating surfaces easily. In some embodiments, each spring tab 204 comprises multiple rows of buttress teeth 206 and the rocket motor assembly 20 comprises multiple corresponding grooves 104.

The spring tabs 204 of the rocket motor assembly 20 are stiff and therefore create resistance to the warhead component 10 to be seated in the rocket motor assembly 20. In one embodiment, several hundred tons of force may be required to push on the warhead causing the high-strength steel tabs to flex outward slightly. The deflection of the spring tabs 204 is within the elastic limit of the rocket motor body material. A radius 214 is located at the root of the spring tab 204. The radius 214 is required to allow the spring tab 204 to flex and return to shape within the elastic limit of the material.

In embodiments in which multiple rows of buttress teeth 206 are required to retain the joint during a set forward event, the teeth 206 are shaped in such a way as to allow for maximum shear area while minimizing the height of the teeth 206. Minimizing the height of the teeth 206 in turn reduces the required deflection of the spring tabs 204 thus allowing the stresses of the part to remain elastic and not permanently deform.

The ring 32 of the spider assembly 30 keeps the leaf springs in a tensile state that the keeps the projectile 1 tightly together.

Figure 4:
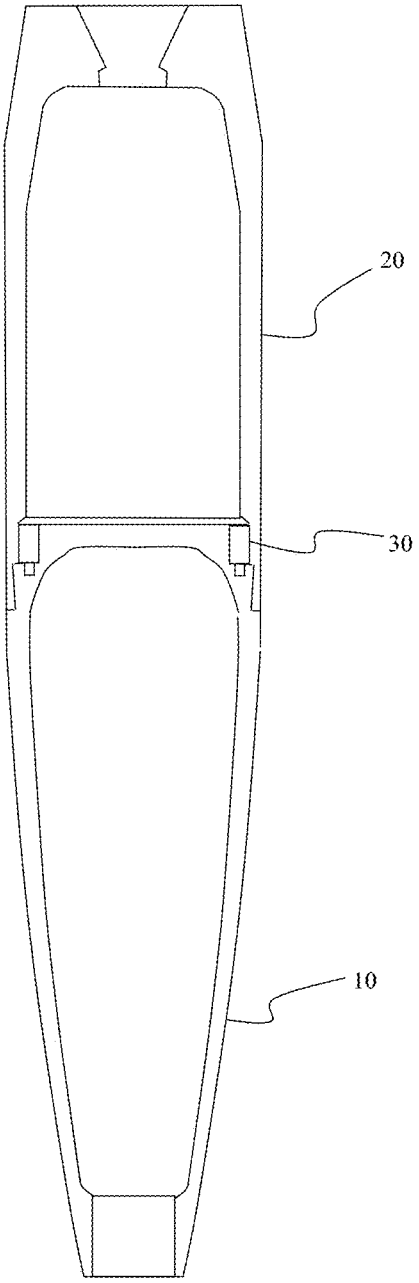
FIG. 4 is a sectioned view of an artillery projectile, according to an illustrative embodiment.

FIG. 4 is a sectioned view of the artillery projectile, according to an illustrative embodiment. The artillery projectile 1 is shown in an assembled state. The warhead component 10 and the rocket motor assembly 20 are joined at the annular-cantilever snap-fit joint formed by the spring tabs 204 and grooves 104. The buttress teeth 206 of the spring tabs 204 are seated within the grooves 104 of the warhead component 10. In addition, the pins 34 of the spider are embedded into the aligned niches 102, 202 of the rocket motor assembly 20 and the warhead component 10.

Figure 5:
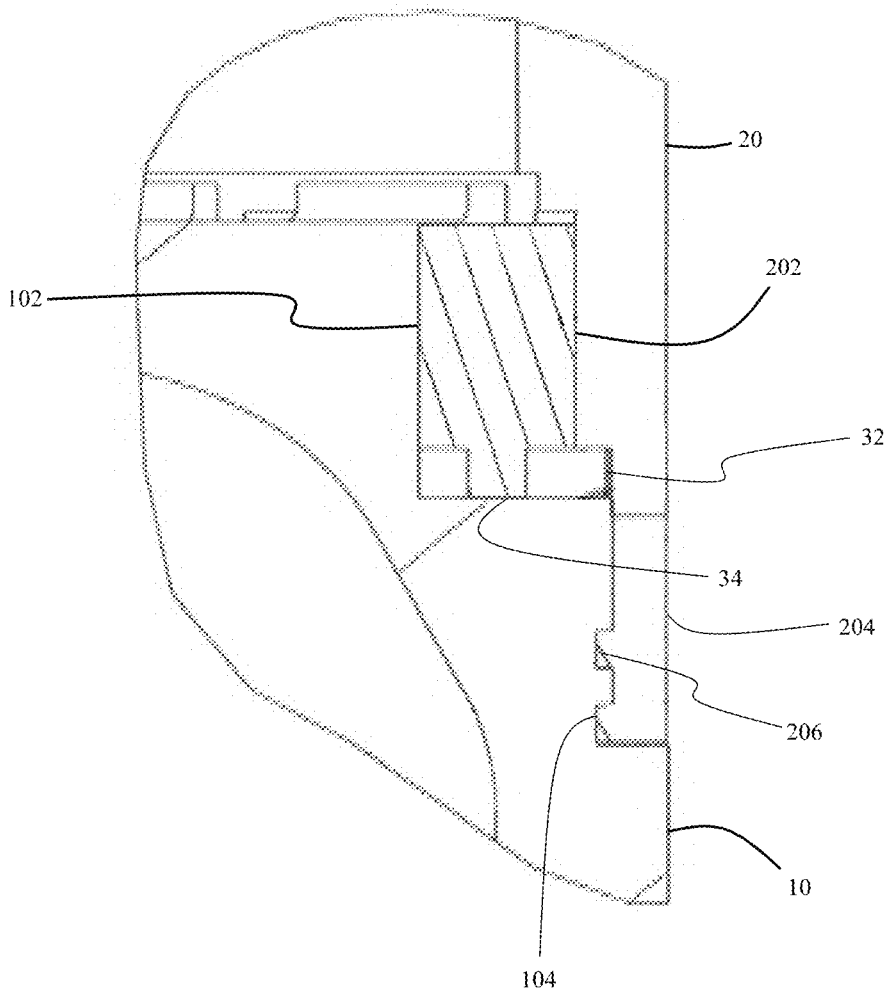
FIG. 5 is a magnified view of the joint between a warhead portion and a rocket motor assembly of the artillery projectile, according to an illustrative embodiment.

FIG. 5 is a magnified view of the joint between a warhead portion and a rocket motor assembly of the artillery projectile, according to an illustrative embodiment. As described above, the joint is formed by the union of the warhead component 10 and rocket motor assembly 20 via the buttress teeth 206 of the spring tabs 204 and the grooves 104 of the warhead component 10.

Figure 6:
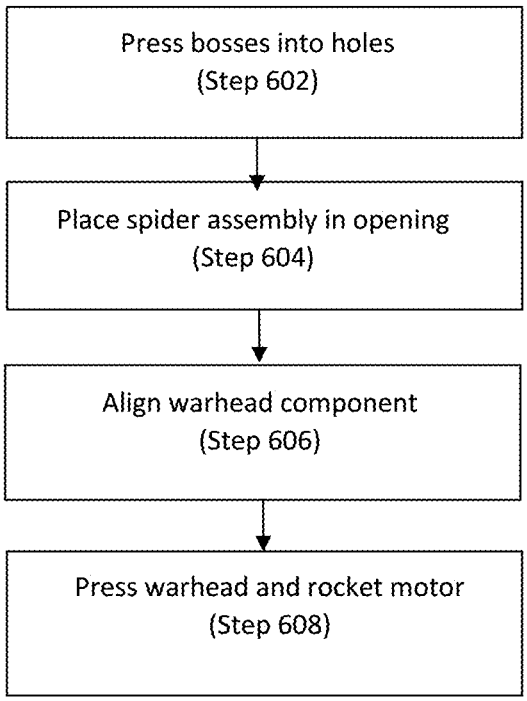
FIG. 6 is a flowchart illustrating a method for assembling a projectile, according to an illustrative embodiment.

FIG. 6 is a flowchart illustrating a method for assembling a projectile, according to an illustrative embodiment. At step 602, the bosses 342 of the plurality of pins 34 are pressed into the holes 322 of the spider ring 32 to assemble the spider assembly 30.

At step 604, the spider assembly 30 is then placed in the opening 208 of the rocket motor assembly 20 such that the ring 32 abuts a rim 212 in the interior of the rocket motor assembly 20. In this position, the pins 34 of the spider assembly 30 fit into the scalloped niches 202 in the rocket motor assembly 20. Unlike current manufacturing processes, this is accomplished in a one step process thereby eliminating placing pins 34 individually into the projectile component.

At step 606, the warhead component 10 is aligned such that the scalloped niches of the warhead are aligned with the scalloped niches of the rocket motor assembly 20. At this point in the assembly, the tips of the buttress teeth 206 on the spring tabs 204 interfere with the underside of the warhead component 10.

At step 608, force is applied to either the warhead component 10 or the rocket motor assembly 20 which causes the buttress teeth 206 to seat within the circumferential grooves 104 of the warhead component 10.

While the invention has been described with reference to certain embodiments, numerous changes, alterations and modifications to the described embodiments are possible without departing from the spirit and scope of the invention as defined in the appended claims, and equivalents thereof.

What is claimed is:

1. A projectile comprising a fore portion and an aft portion joined together via an annular cantilevered snap fit joint and a spider assembly positioned between the fore portion and the aft portion, said spider assembly further comprising a ring and a plurality of pins inserted into the ring and wherein the pins are received into niches defined by interior surfaces of the fore portion and the aft portion.

2. The projectile of claim 1 wherein the projectile is an artillery projectile.

3. The projectile of claim 2 wherein the fore portion is a warhead and the aft portion is a rocket motor.

4. The projectile of claim 1 wherein the projectile is a spin stabilized projectile.

5. The projectile of claim 1 wherein the ring is comprised of a malleable material.

6. The projectile of claim 1 wherein the pins are cylindrical and each further comprises a boss extending from a top surface of the pin, said boss sized and dimensioned to be inserted into a corresponding hole in the ring.

7. The projectile of claim 1 wherein the pins are arranged symmetrically around the ring.

8. The projectile of claim 1 wherein:

the aft portion further comprises a plurality of leaf springs arranged circumferentially around an opening in the aft portion and extending in an axial direction and wherein each leaf spring further comprises a protruding tooth at a distal end thereof;

the fore portion further comprises a circumferential groove defined by an exterior surface of the fore portion; and the annular cantilevered snap fit joint comprises the protruding teeth and the circumferential groove.

9. The projectile of claim 8 wherein each leaf spring is integral to the fore portion.

10. The projectile of claim 8 wherein each leaf spring comprises a radius at a base thereof.

11. The projectile of claim 8 wherein each leaf spring further comprises a plurality of protruding teeth wherein the plurality of protruding teeth are arranged in a plurality of circumferential rings and the fore portion further comprises a plurality of corresponding circumferential grooves.

12. The projectile of claim 8 wherein the protruding teeth are buttress shaped.

13. A method for assembling a projectile comprising the steps of:

providing a fore portion and an aft portion, said aft portion further comprising a plurality of leaf springs arranged circumferentially around an opening of the aft portion and extending in an axial direction and wherein each leaf spring comprises a protruding tooth and said fore portion further comprises a circumferential groove defined by an exterior surface;

assembling a spider assembly by inserting a plurality of pins into corresponding holes arranged symmetrically around a ring;

inserting the spider assembly in the aft portion of the projectile such that the plurality of pins are received within scalloped niches defined by an interior surface of the fore portion;

aligning the fore portion of the projectile with the aft portion of the projectile by aligning scalloped niches defined by the interior surface of the fore portion with scalloped niches of the aft portion; and applying a force to one of the fore portion or the aft portion such that fore portion and the aft portion are brought together and the protruding teeth are seated within the circumferential groove.

* * * * *